US005592837A

United States Patent [19]

McBride

[11] Patent Number: 5,592,837

[45] Date of Patent: Jan. 14, 1997

[54] PICK RESISTANT LOCK

[75] Inventor: Darryl G. McBride, Mocksville, N.C.

[73] Assignee: Universal Lock, Mocksville, N.C.

[21] Appl. No.: 526,569

[22] Filed: Sep. 11, 1995

[51] Int. Cl.[6] ..... E05B 67/22

[52] U.S. Cl. ..... 70/38 A; 70/340; 70/379 R; 70/419

[58] Field of Search ..... 70/38 A, 35, 38 R, 70/356, 379 R, 379 A, 380, 375, 453, 419, 491, DIG. 37, 338, 340, 381

[56] References Cited

U.S. PATENT DOCUMENTS

| | | | |
|---|---|---|---|
| Re. 29,744 | 8/1978 | Patriquin | 70/364 R |
| 1,024,371 | 4/1912 | Soley | 70/379 R |
| 1,589,256 | 6/1926 | Spruth . | |
| 2,292,515 | 8/1942 | George | 70/419 |
| 2,391,834 | 12/1945 | Johnstone | 70/491 |
| 2,557,028 | 6/1951 | Deutsch | 70/491 |
| 2,982,121 | 5/1961 | George . | |
| 3,548,620 | 12/1970 | Genakis | 70/356 |
| 3,693,384 | 9/1972 | Genakis | 70/365 |
| 3,821,886 | 7/1974 | Ladewig | 70/366 |
| 3,979,931 | 9/1976 | Man . | |
| 4,062,211 | 12/1977 | Miller et al. | 70/366 |
| 4,073,171 | 2/1978 | Moorhouse | 70/366 |
| 4,098,100 | 7/1978 | Wah . | |
| 4,345,447 | 8/1982 | Keung et al. . | |
| 4,551,997 | 11/1985 | Huang . | |
| 4,662,198 | 5/1987 | Scherbing | 70/363 |
| 4,686,843 | 8/1987 | Martikainen et al. | 70/366 |
| 4,838,051 | 6/1989 | Yang | 70/38 A |
| 5,148,690 | 9/1992 | Wang | 70/38 A |
| 5,174,136 | 12/1992 | Thwing | 70/38 A |
| 5,186,029 | 2/1993 | Myers | 70/38 A |
| 5,205,143 | 4/1993 | Hakkarainen et al. | 70/366 |
| 5,335,520 | 8/1994 | Lee | 70/349 |
| 5,363,678 | 11/1994 | Meckbach | 70/38 A |
| 5,377,511 | 1/1995 | Meckbach | 70/38 A |

*Primary Examiner*—Steven N. Meyers
*Assistant Examiner*—Donald J. Lecher
*Attorney, Agent, or Firm*—Shefte, Pinckney & Sawyer

[57] ABSTRACT

An essentially pickproof padlock has a housing defining an interior chamber and a keyway with a stacked parallel arrangement of multiple annular cam rings fixed concentrically within the housing. The radially inward annular surface of each cam ring is formed with a respective raceway of a predetermined annular extent and disposition relative to the chamber. A tumbler assembly is disposed within the cam arrangement for selective relative rotational movement. The tumbler assembly has a plurality of slidable pins each with a head portion forming a bearing element. An associated key is formed with a plurality of parallel axial recesses for receiving the pins of the tumbler assembly, each recess being of a selected respective length terminating at a shoulder to collectively engage and move the head portions of the pins into respective operative dispositions within corresponding ones of the raceways wherein the tumbler assembly may be rotated by the key between locked and unlocked dispositions. A looped shackle is mounted at the opposite end of the housing from the keyway to be selectively retained and released by the aforementioned operation of the tumbler assembly.

11 Claims, 4 Drawing Sheets

PICK RESISTANT LOCK

BACKGROUND OF THE INVENTION

The present invention relates generally to locks, especially padlocks and other key-operated locks, and relates more particularly to a novel internal locking mechanism which substantially eliminates the possibility of unauthorized opening of the lock by means of "picking".

Conventional padlocks are widely used in a diversity of applications, representing one of the most common forms of known security locks. Typically, such padlocks comprise a lock body which supports internally a series of rotatable or otherwise movable tumblers controlled by means of a compatibly profiled key insertable into the tumbler assembly through a keyway in the lock body to release and fee one end of a shackle from the lock body when the key properly moves the tumblers into "unlocked" alignment with one another and to otherwise retain the shackle in a "locked" position withdrawn within the lock body. Over the years, advances in metallurgy and hardening techniques have enabled the lock body and shackle to be fabricated of metals which substantially resist cutting and other forms of attempted tampering, thereby improving the security of such locks. Other forms of improvements have been undertaken with regard to the internal locking mechanism itself. However, one disadvantage suffered by substantially all conventional tumbler-type locks intended to be operated only by compatibly profiled keys is that only a moderate amount of skill is required of a person knowledgeable in the construction of such locks to manipulate the tumblers of the locks using a pin or similar device inserted into the keyway and thereby open such a lock without its associated control key, a practice commonly referred to as "picking" the lock.

SUMMARY OF THE INVENTION

It is accordingly an object of the present invention to provide improvements in key-operated locks which substantially minimize and largely eliminate the possibility of unauthorized "picking" of the lock. A more specific object of the present invention is to provide an internal locking mechanism for padlocks and similar key-operated locks which eliminates the use of conventional tumblers. These and other objects of the present invention will be apparent from the following description of the present invention.

Briefly summarized, the novel lock of the present invention basically comprises a housing defining an interior chamber and a keyway opening through the housing into the chamber. The housing has a cam arrangement disposed adjacent the chamber for defining a plurality of generally parallel raceways each of a predetermined limited extent and each in a predetermined disposition relative to the chamber. A tumbler assembly is disposed within the chamber for selective rotational movement therein, the tumbler assembly having a unique plurality of bearing elements supported for movement transversely relative to the cam raceways. A key is insertable into the keyway and, in accordance with the present invention, has a plurality of shoulders at selective spacings from one another to engage and move the multiple bearing elements into respective operative dispositions within corresponding ones of the raceways wherein the tumbler assembly may be rotated by the key between a locked disposition and an unlocked disposition. A locking member, such as a looped shackle, is mounted to the housing for movement between a retained position engaged by the tumbler assembly when in its locked disposition and a released position disengaged by the tumbler assembly when in its unlocked disposition.

The described lock of the present invention is particularly adapted for use in padlocks but will also be recognized and understood to be applicable to various other forms of key-operated locks where security reasons make it desirable to prevent picking of the lock mechanism. In a preferred embodiment, especially adapted to use in a padlock, the interior chamber of the housing is essentially concentric about a lock axis with which the keyway aligns. The cam arrangement is fixed within the housing concentrically about the axis and the keyway and preferably comprises a plurality of annular cam rings disposed in stacked parallel relation to one another encircling the chamber, each cam ring having a radially inward annular surface which defines a respective raceway. According to the present invention, the raceways of the several cam rings are located both in differing parallel planes perpendicular to the lock axis but also at differing annular dispositions about the lock axis. The tumbler assembly is disposed in the interior chamber for selective rotational movement relative to the cam arrangement. The tumbler assembly preferably has a plurality of operating pins disposed to slide axially in differing radial planes relative to the lock axis, with each pin having an enlarged head portion which forms one bearing element of the tumbler assembly. The key is correspondingly formed with a plurality of spaced parallel axially extending recesses disposed in correspondence to the pins of the tumbler assembly in order to receive the pins in the respective recesses upon insertion of the key into the keyway. Each recess of the key is of a selected respective length terminating at a shoulder to engage and slidably move the head portions of the pins collectively into respective operative dispositions within corresponding ones of the cam raceways wherein the tumbler assembly is permitted to be rotated by the key between its locked and unlocked dispositions. As aforementioned, in a preferred embodiment for a padlock, a looped shackle is provided at the opposite end of the housing from the keyway.

DETAILED DESCRIPTION OF THE PREFERRED EMBODIMENT

Figure 1:
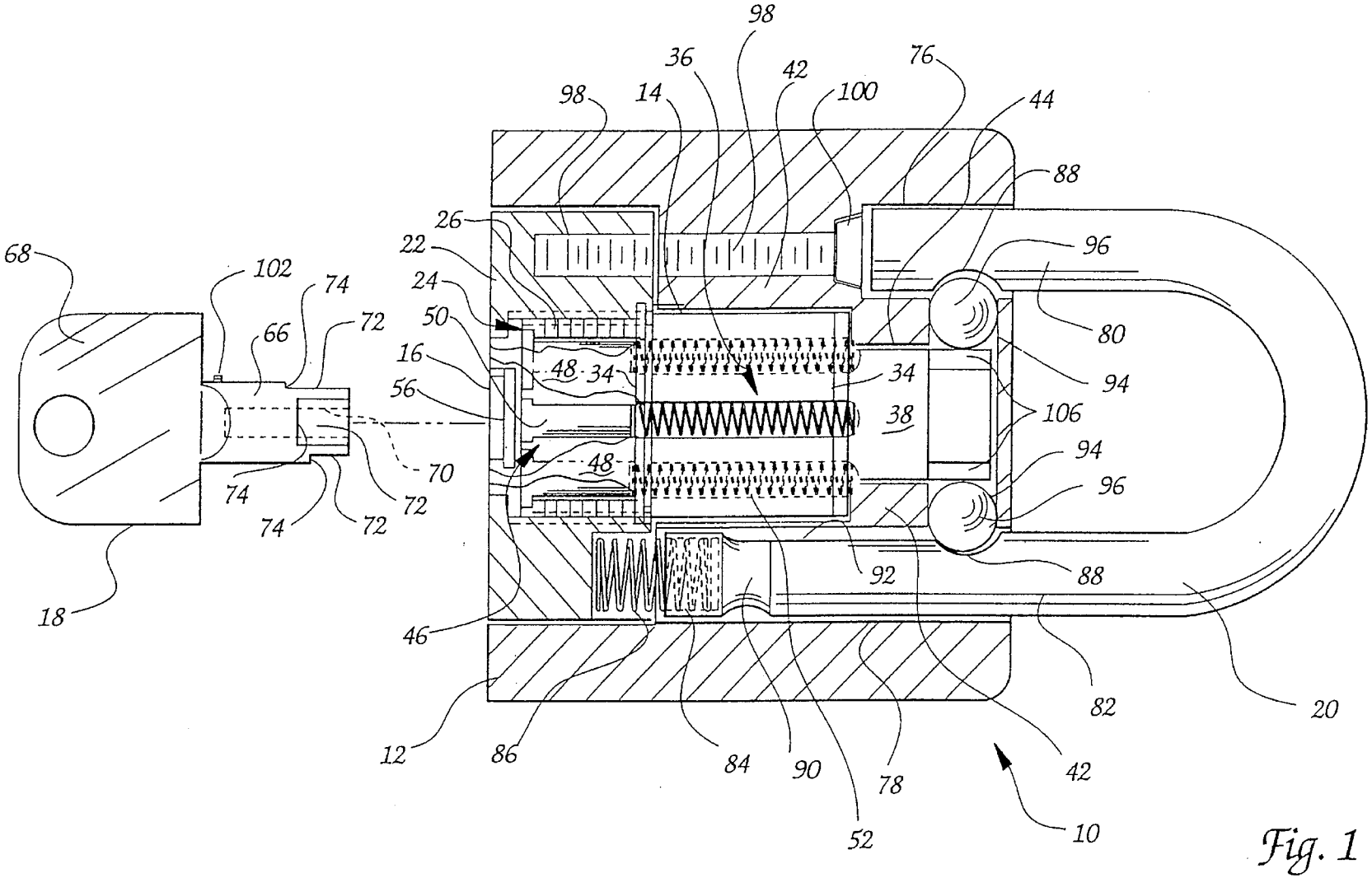
FIG. 1 is a vertical cross-sectional view of a padlock in accordance with one preferred embodiment of the present invention, shown in its locked condition.
Figure 2:
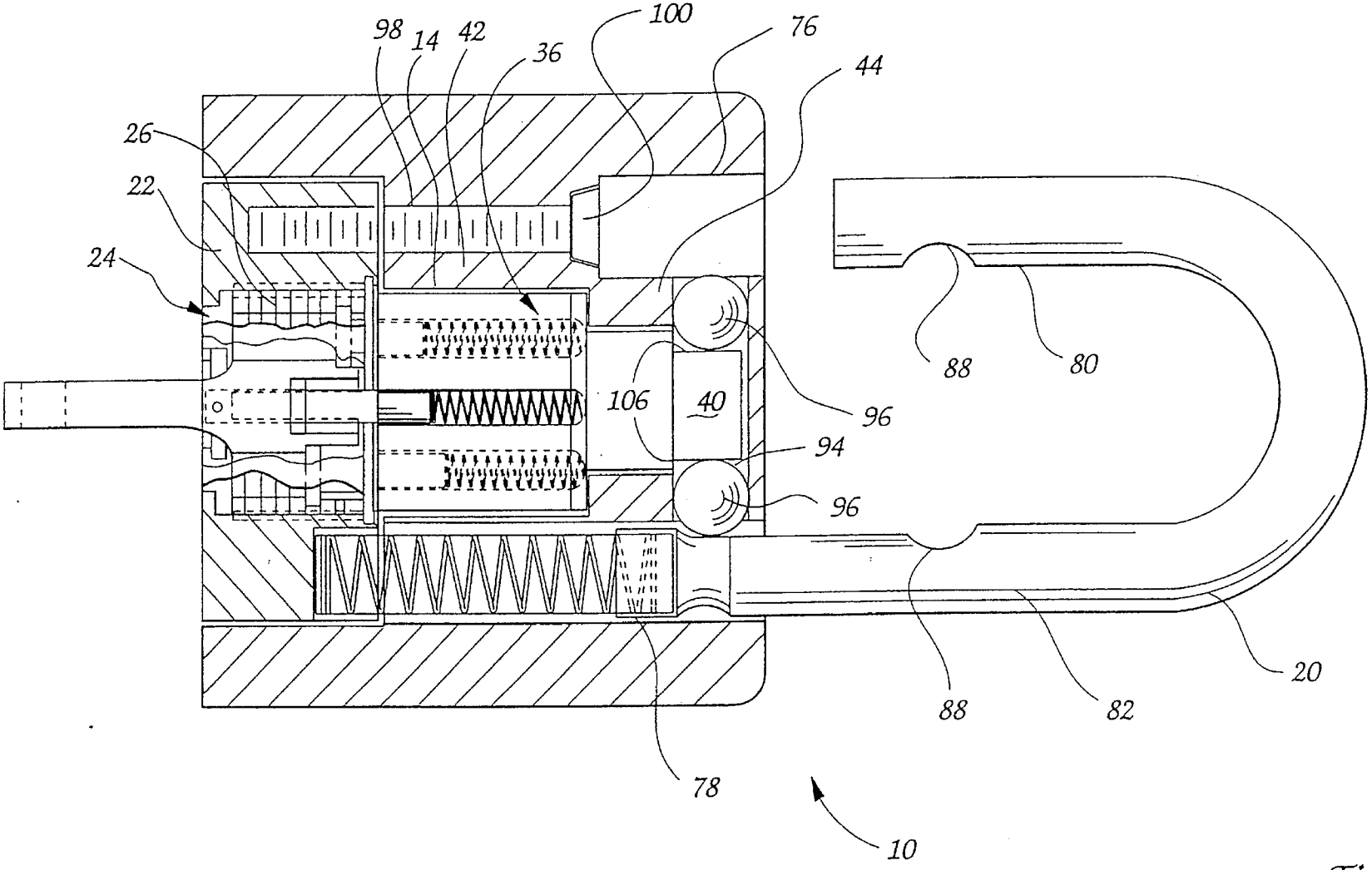
FIG. 2 is another vertical cross-sectional view of the padlock of FIG. 1, but shown in its unlocked condition.

Referring now to the accompanying drawings, one preferred embodiment of the lock of the present invention is illustrated in the form of a padlock, broadly represented in its totality at 10, but, as those persons skilled in the relevant art will appreciate, it is to be understood that the present invention is not limited or otherwise restricted to the particular construction or components depicted in the accompanying drawings, the padlock 10 being illustrated and described herein solely for purposes of disclosing one representative example of an embodiment of the present invention.

The padlock 10 comprises a cylindrical lock body or housing 12 which is at least partially hollow internally to define an interior locking chamber 14 concentrically about a longitudinal axis X of the lock body 12 for receiving and housing the locking mechanism of the padlock 10, more fully described below. One axial end of the lock body 12 defines a keyway 16 opening coaxially into the interior locking chamber 14 for insertion and removal of an operating key 18 for locking and unlocking operation of the padlock 10, as described hereinafter, and the opposite end of the lock body 12 is formed with two cylindrical bores which receive the opposite ends of a looped J-shaped shackle 20.

Figure 3:
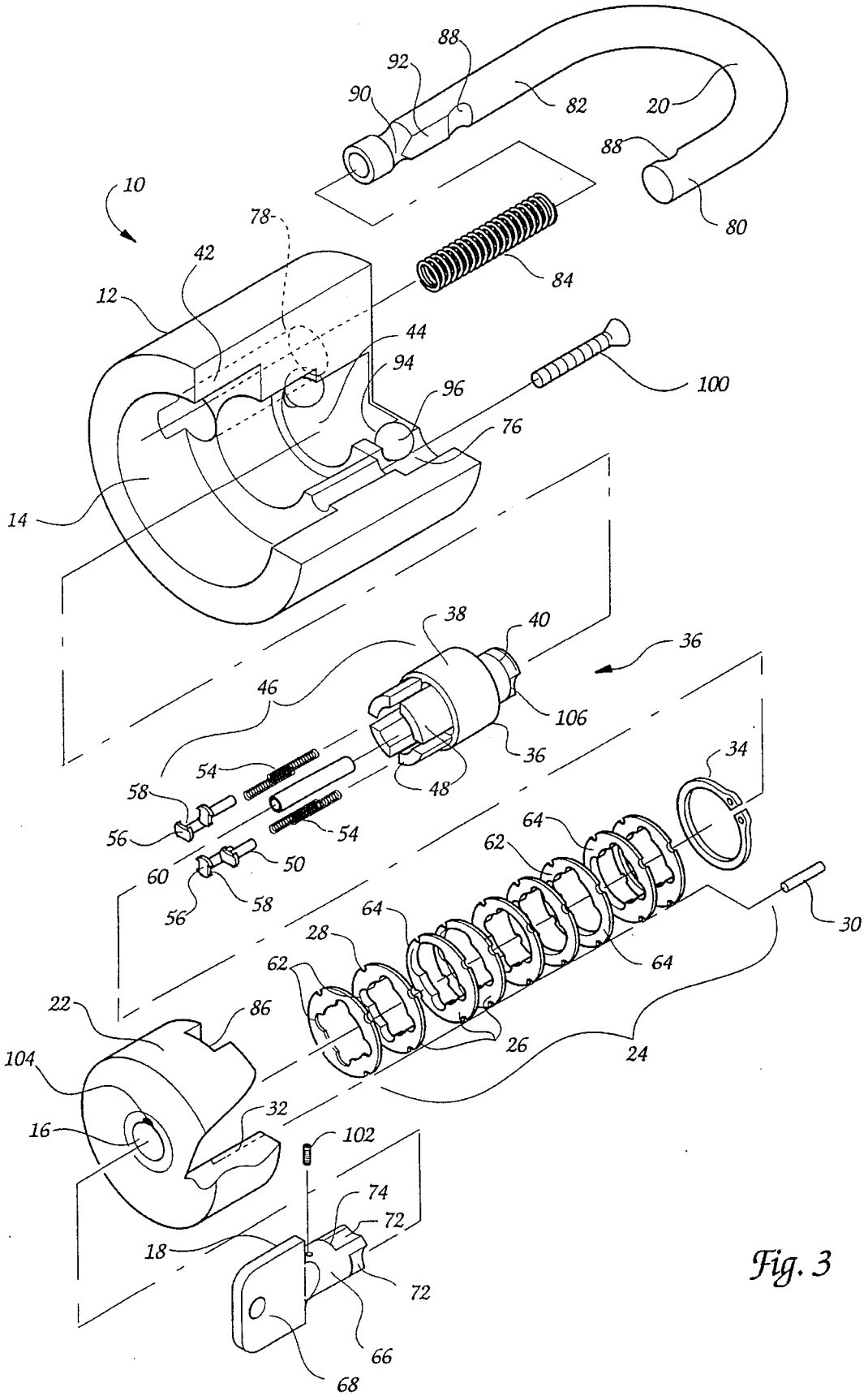
FIG. 3 is an exploded perspective view of the individual components of the padlock of FIGS. 1 and 2.

The lock body 12 includes a cylindrical insert 22 fitted securely within the first-mentioned end of the lock body 12 concentrically with respect to the chamber 14, the keyway 16 being formed in an outwardly facing end surface of the cylindrical insert 22. A cam arrangement, indicated in its totality at 24, is fixed interiorly within the cylindrical insert 22 immediately adjacent and encircling the keyway 16, the cam arrangement 24 comprising a plurality of annular cam rings 26 securely fitted and supported within the cylindrical interior of the insert 22 in stacked parallel relation to one another. Each of the cam rings 26 has a circular outer periphery formed at equidistant circumferential spacings with a semicircular recess 28 (see FIG. 3) which are aligned with one another in the stacked disposition of the cam rings. One set of the aligned recesses 28 in the cam rings receives a cylindrical keypin 30 (see also FIG. 3) which also fits within a corresponding axially extending semicircular recess 32 formed in the annular interior face of the insert 22, thereby to secure the cam rings 26 against undesired rotation relative to the insert 22. Likewise, a lock ring 34 is fitted within the interior of the insert 22 at its inwardmost end to retain the cam rings 26 in stacked relation against undesired axial movement relative to the insert 22.

A tumbler assembly, indicated in its totality at 36, is disposed coaxially within the interior locking chamber 14 for selective rotational movement relative to the cam arrangement 24 under the operating control of the key 18, in a manner more fully described hereinafter. The tumbler assembly 36 includes a central cylindrical body 38 supported centrally within the chamber 14 of the lock body 12 by a correspondingly cylindrical bearing portion 42 of the lock body 12. A shackle-operating hub 40 is formed integrally with the main tumbler body 38 to project axially into a reduced diameter bore 44 in the bearing portion 42 to control locking retention and unlocking release of the shackle 20 in dependence upon the rotational disposition of the tumbler assembly 36, as described hereinafter. The tumbler assembly 36 also includes a locking mechanism 46 projecting axially from its opposite end to be disposed concentrically within the cam arrangement 24.

The locking mechanism 46 basically comprises four support arms 48 formed integrally with the cylindrical main body 38 of the tumbler assembly 36 to extend in axially parallel relation to one another at equal circumferential spacings at the outer cylindrical periphery of the tumbler body 38. Disposed between the four support arms 48 are four operating pins 50, each slidably received in an axial bore 52 (FIG. 1) formed in the main cylindrical body 38 of the tumbler assembly 36 and biased outwardly by a corresponding coil spring 54 disposed within the respective bore 52. Each operating pin 50 has an enlarged head 56 at its axially outwardmost free end, the heads 56 being sufficiently enlarged to extend radially outwardly from the support arms 48, with each head 56 also being formed with laterally opposed recesses 58 to receive adjacent guide edges of the support arms 48, whereby the support arms 48 guide axial sliding movement of the operating pins 50 within their respective bores 52. A key centering pin 60 (FIG. 3) extends from the axial center of the main cylindrical body 38 of the tumbler assembly 36 centrally within and in parallel relation to the support arms 48.

Figure 4:
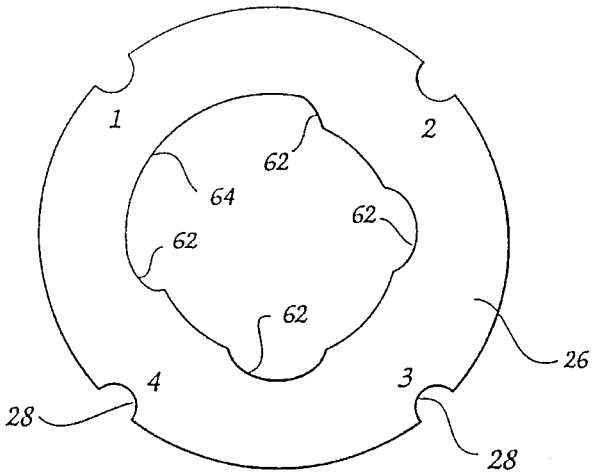
FIGS. 4–7 are plan views of three differing possible cam rings for the padlock of FIGS. 1–3.
Figure 5:
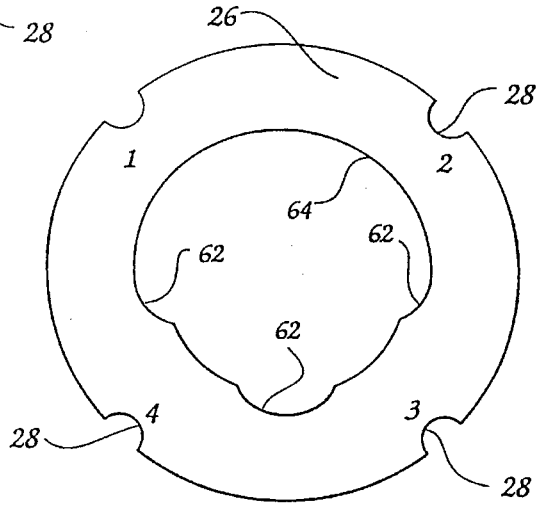
Figure 6:
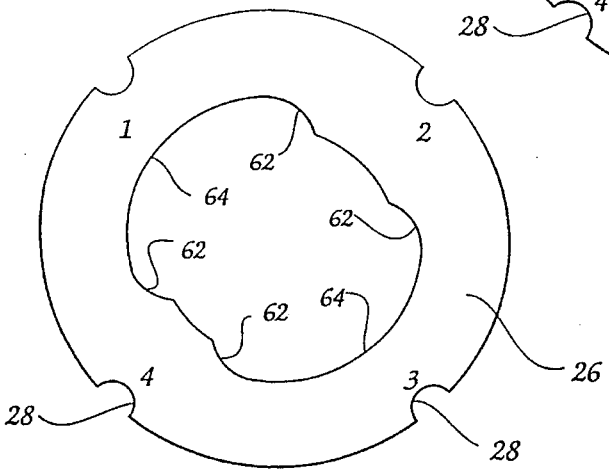

According to the present invention, the cam rings 26 of the cam arrangement 24 are formed with a particular profiled configuration at their respective radially inwardly facing annular surfaces. As best seen in FIGS. 3–6, each of the cam rings 26 is formed with four equidistant semicircular recesses 62 in its radially inward annular surface, all of which are aligned respectively with one another in the stacked arrangement of the cam rings 26, to accommodate axial sliding movement of the pin heads 56 of the tumbler assembly 36 within the recesses 62. However, the portions of the cam rings 26 between the recesses 62 project sufficiently radially inward to laterally engage the pin heads 56 and thereby prevent rotational movement of the tumbler assembly 36, except that at least one quadrant of each cam ring 26 (i.e., the annular area between two adjacent recesses 62) is removed to form a raceway 64 extending approximately 90° about the respective cam ring 26 thereby to permit a respective pin head 56 to travel 90° within the raceway 64 between two adjacent recesses 62. FIGS. 4, 5 and 6 illustrate three possible cam ring designs, it being understood that other cam ring designs are of course possible. A cam ring 26 such as shown in FIG. 5 having two adjacent quadrants removed to form a 180° raceway 64 or as shown in FIG. 6 having two distinct 90° raceways permits two pin heads 56 to travel within the same cam ring 26. Hence, the arrangement of the cam rings 26 normally prevents rotation of the tumbler assembly 36 except only when all of the heads 56 of the operating pins 50 are depressed against the biasing force of their respective springs 54 to respective levels at which the pin heads 56 simultaneously reside within respective raceways 64 of the cam rings 26 so as to permit all of the pin heads 56 to simultaneously move 90° in the same rotational direction.

Figure 7:
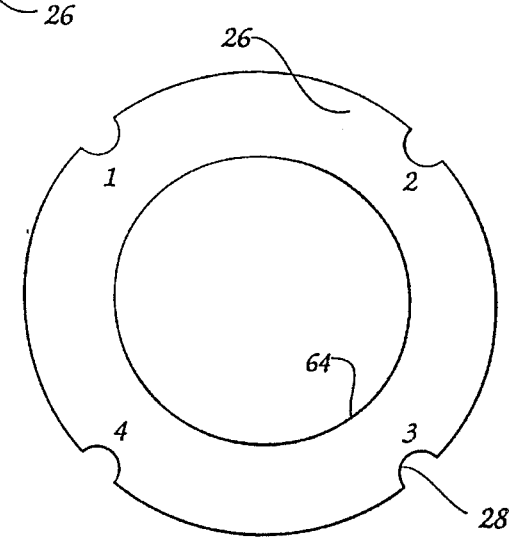

FIG. 7 illustrates another possible cam ring 26 configuration wherein the raceway 64 extends continuously the full 360° annular extent of the cam ring 26. By positioning such a cam ring 26 at the same location in the cam ring stack of each lock, all such locks are thereby capable of being operated not only by their own respective keys but also by a master key operative to depress the pin heads 56 simultaneously into the raceway of such cam ring.

Such is the function of the key 18. As depicted in the drawings, the key 18 has an operating shaft 66 of a generally cylindrical configuration formed integrally with a flat flange portion 68 by which the key shaft 66 may be manually turned. The shaft 66 is of a substantially cylindrical configuration to be insenable into the keyway 16 and into the locking mechanism 46 of the tumbler assembly 36, and the shaft 66 has an axial length sufficient to extend the axial length of the cam arrangement 24 when so inserted. A bore 70 is formed in the free end of the key shaft 66 to receive the key centering pin 60 of the tumbler assembly 36 when so inserted. The cylindrical periphery of the key 18 is formed with four equidistantly spaced axial recesses 72, each terminating in a radial shoulder 74. As will thus be understood, when the shaft 66 of the key 18 is inserted into the keyway 16 and therefrom into the locking mechanism 46 of the tumbler assembly 36, the axial recesses 72 initially receive the respective pin heads 56 and ultimately engage the pin heads by the radial shoulders 74 to depress each respective pin head 56 against its biasing spring 54. By selective determination of the respective axial length of each recess 72 and the attendant axial disposition of the associated shoulder 74, the distance to which each pin head 56 is depressed upon insertion of the key 18 can be selectively determined and, in turn, the key 18 can be profiled to properly depress the pin heads 56 simultaneously to the correct respective levels at which the tumbler assembly 36 is permitted to rotate with the pin heads 56 in respective raceways 64 of the cam rings 26.

The axial end of the lock body 12 opposite the keyway 16 is formed with a pair of bores 76, 78 extending axially through the lock body 12 at diametrically opposed locations radially outwardly of the interior bore 44 so as to extend axially through the bearing portion 42 of the lock body 12, for receiving the opposite ends of the shackle 20. As aforementioned, the shackle 20 is of a looped J-shaped configuration forming two shackle legs 80,82 extending in spaced parallel relation to one another, with the leg 82 being of a substantially greater length than the leg 80 to serve as a mounting leg for the shackle 20. The bore 78 is adapted to receive the shackle mounting leg 82 and is therefore formed to extend completely through the bearing portion 42 of the lock body 12, with an aligned recess 86 also being formed in the adjacent portion of the end face of the cylindrical cam insert 22 to form a seat for a biasing spring 84 extending axially into the bore 78 to act upon the inward end of the shackle mounting leg 82, whereby the shackle 20 is urged by the spring 84 axially outwardly from the lock body 12 into an opened condition wherein the other shackle leg 80 is freed from the lock body 12. The inwardly facing surfaces of the shackle legs 80, 82 are respectively formed with arcuate recesses 88, located in the shackle leg 80 immediately adjacent its free end and in the shackle leg 82 directly opposite the recess 88 in the shackle leg 80. Additionally, the shackle leg 82 is formed further with a recess 90 of an arcuate profile extending continuously about the full annular extent of the shackle leg 82 immediately adjacent its free end, with the intermediate length of the shackle leg 82 between its recesses 88, 90 being flattened at 92 to form a bearing race between the two recesses 88, 90.

A pair of bores 94 are formed in the lock body 12 to extend in alignment with one another radially between the interior bore 44 and the respective bores 76, 78 for the shackle legs 80, 82, and a pair of ball bearings 96 are seated in such bores 94 to move radially therein between a locking disposition projecting radially outwardly into the bores 76, 78 to engage in the shackle recesses 88 and thereby retain both shackle legs 80, 82 against withdrawal outwardly from the lock body 12 and an unlocked disposition projecting radially inwardly into the interior bore 44 permitting release of the shackle legs 80, 82. In the unlocked disposition of the ball bearings 96, the spring 84 is permitted to act upon the inward end of the shackle leg 82 to push the shackle 20 outwardly from the lock body 12, but the ball bearing 96 adjacent the corresponding shackle bore 78 still projects sufficiently into the bore 78 to ride along the bearing race 92 and engage the enlarged terminal end of the shackle leg 82 so as to prevent complete removal of the shackle 20 from the lock body 12.

A screw bore 98 may be formed axially through the lock body 12 between the terminal inward end of the shackle bore 76 and the interior chamber 14 in order to receive a screw 100 threaded into the cylindrical insert 22. In this manner, the screw 100 assists in retaining the cylindrical insert 22 in fixed disposition within the chamber 14 against undesired rotational movement of the insert 22, with access to the screw 100 being prevented except upon authorized opening of the lock 10. Of course, those persons skilled in the art will readily recognize and understand that many other means exist for securing the insert 22 within the lock body 12.

The operation of the present lock 10 will thus be understood. In the locked condition of the lock 10 shown in FIG. 1, the key 18 is removed from the keyway 16 and the tumbler assembly 36 resides in a rotational disposition within the cam arrangement 24 in which the shackle operating hub 40 of the tumbler assembly 36 is rotated to force the ball bearings 96 outwardly into engagement within the recesses 88 in the shackle legs 80, 82 to retain both shackle legs locked within their respective bores 76, 78. As will be noted in FIG. 3, the key shaft 66 is formed with a radial protuberance 102 and the keyway 16 is similarly formed with a corresponding radial recess 104 to guide correct insertion of the key 18 into the keyway 16. Upon such correct insertion of the key 18 fully into the keyway 16, the radial shoulders 74 on the key shaft 66 respectively engage and depress the pin heads 56 to respective levels at which each of the pin heads 56 reside in a corresponding one of the cam raceways 64, thereby permitting the key 18 to rotate the entire tumbler assembly 36. The shackle operating hub 40 of the tumbler assembly 36 is formed at diametrically opposed sides with ball bearing recesses 106 which are thereby rotated with the tumbler assembly 36 into direct alignment with the radial bores 94 so as to permit the ball bearings 96 therein to move radially inwardly out of the shackle recesses 88 and into the ball bearing recesses 106 of the tumbler hub 40, thereby releasing the shackle 20 for withdrawal from the lock body 12. As aforementioned, the ball bearing 96 associated with the shackle bore 78 still projects sufficiently into the bore 78 to engage in the annular recess 90 so as to prevent complete removal of the shackle 20.

As will thus be understood, the particular mechanical arrangement of the lock 10 provides secure locking and unlocking operation comparable if not superior to any conventional padlock or other key-operated lock. Advantageously, after opening of the lock 10, the key 18 is always retained within the lock body 12 against removal from the keyway 16 by means of the radial protuberance 102 until the freed leg 80 of the shackle 20 is returned into its bore 76 permitting the key 18 to be rotated in reverse and removed. In this manner, the lock 10 provides the advantage of preventing undesired loss of the key 18. A much more significant advantage of the present lock is that the unique construction of the tumbler assembly 36, particularly its provision of circumferentially spaced operating pins 50, in conjunction with the provision of the stacked cam rings 26 of the cam arrangement 24, makes it extremely difficult, if not essentially impossible, to accomplish unauthorized opening of the lock by "picking" because, unless and until the operating pins 50 are simultaneously depressed to and held at the respectively differing levels determined by the associated cam rings 26, the tumbler assembly 36 cannot be turned. Without the unique key 18 of the present invention, it would be virtually impossible to so manipulate the operating pins 50 and then also induce rotation of the tumbler assembly 36. Hence, the lock 10 of the present invention provides markedly superior security against unauthorized opening than any known conventional padlock or comparable key-operated lock.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A lock comprising a housing defining an interior chamber having a chamber axis and a keyway opening through said housing axially into said chamber, said housing having stationary cam means disposed annularly adjacent said chamber for defining a plurality of generally parallel raceways each having a predetermined limited extent anularly with respect to said chamber and each in a separate predetermined planar disposition axially relative to said chamber, a tumbler assembly disposed within said chamber for selective rotational movement therein about the chamber axis, said tumbler assembly having a plurality of bearing elements supported for movement axially relative to said raceways, a key insertable into said keyway and having a plurality of shoulders at selective spacings from one another to engage and move said plurality of bearing elements axially into respective operative dispositions within corresponding ones of said raceways enabling annular movement of said bearing elements along the raceways in at least two parallel planes without movement of the cam means wherein said tumbler assembly may be rotated by said key between a looked disposition and an unlocked disposition, and a locking member mounted to said housing for movement between a retained position engaged by said tumbler assembly when in its said locked disposition and a released position disengaged by said tumbler assembly when in its said unlocked disposition.

2. A lock according to claim 1 wherein said cam means extends annularly about said chamber and said keyway.

3. A lock according to claim 2 wherein said plural raceways are formed on a radially inward annular surface of said cam means.

4. A lock according to claim 3 wherein said cam means comprises a plurality of annular cam rings each defining one respective said raceway.

5. A lock according to claim 4 wherein said raceway of one said cam ring has a continuous 360° extent to accept a master key operative to position each bearing element within said continuous raceway.

6. A lock according to claim 2 wherein said cam means is disposed annularly about said tumbler assembly.

7. A lock according to claim 6 wherein said tumbler assembly defines a portion of said keyway.

8. A lock according to claim 2 wherein said tumbler assembly comprises a plurality of slidable pins each having a head portion forming a respective one of said bearing elements, each said pin being movable axially relative to said cam means between an inoperative disposition wherein its said bearing element is spaced from a corresponding one of said raceways and said operative disposition wherein its said bearing element is disposed within said corresponding raceway.

9. A lock according to claim 2 wherein said key comprises a plurality of parallel axial recesses each of a selected respective length, a terminal end of each said recess forming one said shoulder.

10. A lock according to claim 1 wherein said lock is a padlock and said locking member is a shackle one end of which is freed from said housing in said released position and is captured within said housing in said retained disposition.

11. A padlock comprising a housing defining an interior chamber concentric about an axis and a keyway opening into said chamber through one end of said housing in alignment with said axis, stationary cam means fixed within said housing concentrically about said axis, said cam means comprising a plurality of annular cam rings disposed in stacked parallel relation to one another, each said cam ring having a radially inward annular surface which defines a respective raceway of a predetermined limited annular extent and disposition in relation to said chamber, a tumbler assembly disposed within said cam means for selective rotational movement relative thereto about the axis, said tumbler assembly having a plurality of slidable pins each having a head portion forming a bearing element, a key insertable into said keyway and having a plurality of parallel axial recesses for receiving said pins of said tumbler assembly, each said recess being of a selected respective length terminating at a shoulder to engage the head portion of a corresponding one of said pins, said shoulders being operative to slidably move collectively said head portions of said pins axially into respective operative dispositions within corresponding ones of said raceways enabling annular movement of said head portions along the raceways without movement of the cam means wherein said tumbler assembly may be rotated by said key between a locked disposition and an unlocked disposition, and a looped shackle mounted to an end of said housing opposite said keyway for movement between a retained position wherein opposite ends of said shackle are engaged by said tumbler assembly when in its said locked disposition and a released position wherein one end of said shackle is disengaged by said tumbler assembly when in its said unlocked disposition.

* * * * *

UNITED STATES PATENT AND TRADEMARK OFFICE

CERTIFICATE OF CORRECTION

PATENT NO. : 5,592,837

DATED : January 14, 1997

INVENTOR(S) : Darryl G. McBride

It is certified that error appears in the above-identified patent and that said Letters Patent is hereby corrected as shown below:

Column 1, line 16, delete "fee" and insert therefor --free--.

Column 4, line 53, delete "insenable" and insert therefor --insertable--.

Column 7, line 21, delete "anu-" and insert therefor --annu- --.

Column 7, line 36, delete "looked" and insert therefor --locked--.

Signed and Sealed this

FourthDay of August, 1998

Bruce Lehman

*Attest:*

BRUCE LEHMAN

*Attesting Officer*

*Commissioner of Patents and Trademarks*